United States Patent [19]

Hanson

[11] 4,336,577

[45] Jun. 22, 1982

[54] MOUNTING PADS FOR PLASTIC PAR LAMP

[75] Inventor: James M. Hanson, Euclid, Ohio

[73] Assignee: General Electric Company, Schenectady, N.Y.

[21] Appl. No.: 61,910

[22] Filed: Jul. 30, 1979

[51] Int. Cl.[3] ..... F21V 29/00

[52] U.S. Cl. ..... 362/267; 362/299; 362/350; 362/308; 362/255; 362/310; 362/306; 362/320; 362/329; 362/346

[58] Field of Search ..... 362/211, 24, 26, 299, 362/329, 327, 341, 349, 306, 263, 264, 294, 301, 306, 345, 308, 310, 320, 346, 350, 255; 313/113; 260/248, 249

[56] References Cited

U.S. PATENT DOCUMENTS

| | | | |
|---|---|---|---|
| 3,314,331 | 4/1967 | Wiley . | |
| 3,725,698 | 4/1973 | Craig . | |
| 3,732,415 | 5/1973 | Lindae . | |
| 3,784,807 | 1/1974 | Boekkool . | |
| 3,885,149 | 5/1975 | Wolfe et al. | 313/318 |
| 3,898,451 | 8/1975 | Murphy | 313/113 |
| 4,019,045 | 4/1977 | Bassett . | |
| 4,190,976 | 3/1980 | Hurt | 362/267 |
| 4,210,841 | 7/1980 | Vodicka | 313/113 |
| 4,240,131 | 12/1980 | Albrecht | 362/267 |
| 4,282,565 | 8/1981 | Hanson et al. | 362/267 |

*Primary Examiner*—Peter A. Nelson

*Attorney, Agent, or Firm*—John F. McDevitt; Lawrence R. Kempton; Philip L. Schlamp

[57] ABSTRACT

Improved seating or mounting pads are provided in a plastic reflector for a parabolic aluminized reflector (PAR) lamp and, in particular, hollow mounting pads are located at each corner of a rectangular shaped plastic reflector member to avoid deformation of the parabolic cavity when the reflector member is formed. In a preferred embodiment, the reflector member is of a unitary molded construction which further includes a sealing rim and with said mounting pads comprising semi-circular hollow boss elements which are located on the rear surface of said sealing rim and project backwardly therefrom to terminate on the parabolic cavity surface.

2 Claims, 3 Drawing Figures

82
80
78
62
88
74
72
16
78
68
70
84
66
86
64
94
77
74
72
76
98
42
12
96
62
92
90
54
52

MOUNTING PADS FOR PLASTIC PAR LAMP

RELATED PATENT APPLICATION

U.S. patent application Ser. No. 58,061, filed July 16, 1979, in the names of James M. Hanson and Irving Bradley, which is now U.S. Pat. 4,282,565, and assigned to the present assignee, describes a sealed prefocused plastic mount construction for plastic PAR lamps having the same general construction disclosed herein as preferred. More particularly, said plastic block mount comprises mating parts which define a cavity for receiving the lead wires of an associated light source and with said cavity being filled with an elastomeric polymer providing a leak-proof enclosure. A further leak-proof seal is provided by the means employed to join said mount construction to the lamp reflector member. Locating or reference surfaces on the mount construction reflector member cooperate to generally provide accurate positioning of the light source at the focus of said reflector member.

BACKGROUND OF THE INVENTION

Glass sealed beam headlamps have been used in motor vehicles for some time and a rectangular shaped headlamp unit has been introduced more recently which includes mounting or seating pads formed in the glass reflector member of said assembly when initially pressed. These mounting pads are solid boss elements located at each corner of the rectangular-shaped reflector member in the sealing rim region to provide means for mounting the reflector after having the glass lens member hermetically sealed thereto in the headlamp receptacle of the vehicle. Problems were encountered when solid mounting pads were molded as part of a unitary construction in a plastic PAR lamp reflector having the same general rectangular shape, however, due to excessive shrinkage of the plastic material upon cooling. More particularly, the amount of plastic in said solid plastic boss elements produced enough shrinkage at the corners of the rectangular shaped member to both deform the parabolic cavity of said member at these locations as well as deform the sealing rim in adjacent regions and thereby hamper obtaining a leak-proof seal when the lens member of the unit is assembled thereto. It would be desirable to avoid all such deformation in a manner which does not require substantial alteration of the existing reflector configuration.

SUMMARY OF THE INVENTION

It has now been discovered that a hollow construction of said mounting pads avoids all the foregoing deformation when said plastic reflector member is molded. Specifically, boss elements of a hollow construction can be located on the rear surface of the sealing rim of the rectangular shaped plastic reflector member and with said hollow boss elements projecting backwardly therefrom to terminate on the back side of the parabolic cavity surface of said member.

In a preferred embodiment, the improved rectangular shaped plastic reflector member of the present invention includes a parabolic shaped cavity characterized by opposing generally parallel planes which intersect the parabolic contour and terminate in an outer sealing rim, receptacle means disposed on the rear side of said reflector which accommodates a prefocused mount construction to locate a light source at the focus of said reflector, and mounting pads on the rear side of said reflector which are disposed at each corner of the rectangular shape in the sealing rim region, and wherein the improvement consists of having said mounting pads being of a hollow construction to avoid deformation of the parabolic cavity when said reflector member is formed. A preferred reflector lamp utilizing said improved plastic reflector construction further includes a rectangular shaped plastic lens sealed to the front surface of the sealing rim on said reflector and further includes a prefocused light source mount sealed to the receptacle means of said reflector, said prefocused light source mount comprising at least two lead wires, at least two electrical connecting means joined one each to said lead wires, a plastic block having mating parts defining a cavity for receiving said joint lead wires with elastomeric polymer in the cavity of said block to provide a leak-proof seal, and a light source connected to the end of said lead wires outside said block.

The preferred mount construction for said reflector lamp is that described in the aforementioned U.S. patent application Ser. No. 58,061. Accordingly, said prefocused mount construction is in the form of a plastic block comprising mating parts which define a cavity for receiving the lead wires, said mating parts comprising an inner container member defining said cavity which is fitted into an outer housing member. Said inner and outer parts of the mount construction are sealed together after assembly of the lead wires in the cavity by filling with an elastomeric polymer which provides a leak-proof seal around the lead wires. In said preferred embodiment, the inner container member of the mount assembly has a box-like form which is fitted into an outer box-like member and with the box-like members being thereafter sealed together at the periphery of the inner member by ultrasonic welding. The assembled mount construction having at least two electrical leads extending therefrom can thereafter have the light source assembled to the inleads at a position fixed with respect to a locating surface on the mount construction which prefocuses said light source. The assembled mount and light source can thereafter be fitted to reference features of the receptacle means molded in the rear outer surface of said reflector member to provide still further positioning of the light source at the focus of said reflector. The preferred light source of said reflector lamp is a tungsten halogen incandescent lamp such as described in U.S. Pat. No. 4,139,794, which is assigned to the present assignee.

DESCRIPTION OF THE PREFERRED EMBODIMENTS

Figure 1:
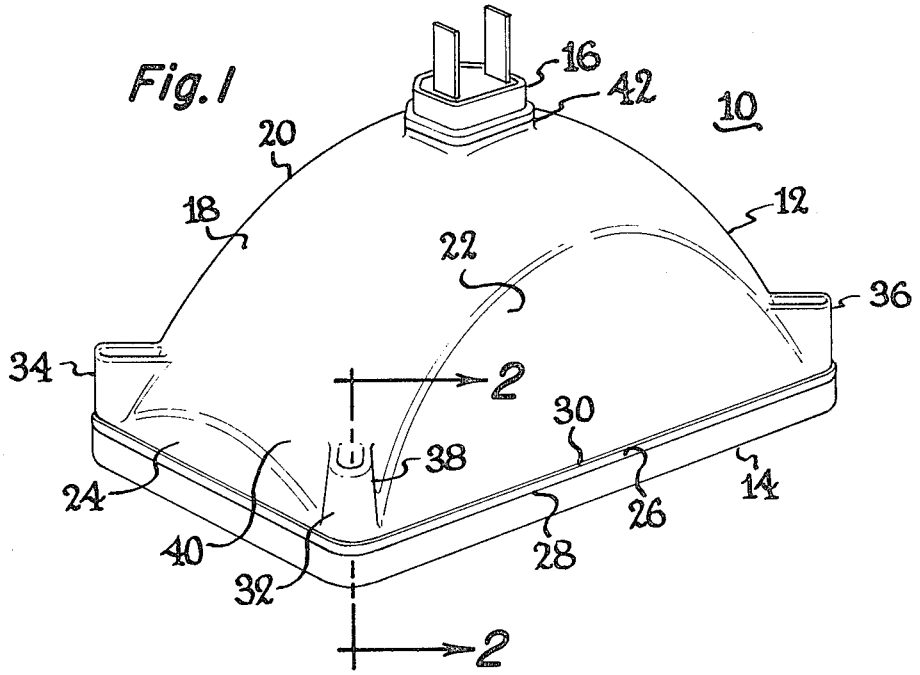
FIG. 1 is a perspective view of an assembled rectangular shaped plastic PAR lamp according to the present invention.

Referring to FIG. 1, there is shown in perspective an assembled all plastic PAR lamp 10 which comprises a rectangular shaped plastic reflector member 12, a plastic lens member 14 joined thereto, and a prefocused plastic block mount and light source unit 16 joined to the plastic reflector member at the rear side thereof. Said plastic reflector member 12 comprises a parabolic shaped cavity 18 which is intersected, as shown, by a pair of opposing generally parallel planes 20 and 22 to form the longer sides of said rectangular shaped member. The remaining shorter sides of said rectangular shaped member are also formed by intersection of the parabolic shaped cavity with a pair of opposing generally parallel planes of which only plane 24 can be observed in the drawing. A sealing rim 26 having a rectangular shape is defined by intersection of the longer opposing planes or side walls with the shorter opposing planes or end walls of said reflector member. Said sealing rim includes a front sealing surface 28 as well as a rear surface 30 from which the mounting pads of the present invention project upwardly. Three of said mounting pads 32, 34 and 36 are shown in the drawing as being of a hollow construction and are disposed at each corner of the rectangular shaped reflector member in the sealing rim region. Specifically, said mounting pads each comprise a semi-circular boss element 38 of hollow construction which is located on the rear surface of the sealing rim and projects backwardly therefrom to terminate on the outer parabolic cavity surface 40. The plastic block mount and light source unit 16 which is joined to the rear side of the reflector member can have the same construction as described in the aforementioned U.S. patent application Ser. No. 58,061 along with the manner of joining said mount construction to the same general type reflector member described herein. Accordingly, it need only further be explained in the present application that said mount and light source unit (said light source not being shown) is fitted into a raised cavity of receptacle means 42 disposed on the rear side of said reflector member and thereafter joined thereto to provide a leak-proof seal for the lamp assembly. It will be further apparent from the drawing that all structural features of said reflector member construction including the present hollow mounting pad elements can be formed in a unitary molded construction by conventional techniques such as injection molding.

Figure 2:
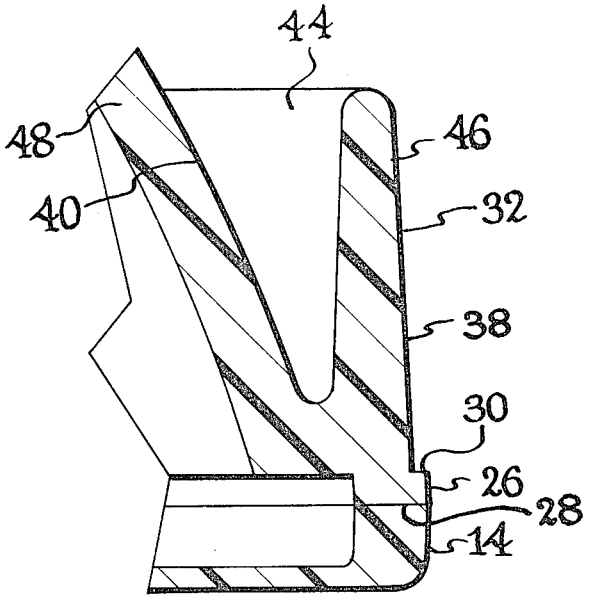
FIG. 2 is a cross sectional view of one mounting pad depicted in the assembled lamp of FIG. 1.

A single mounting pad having the present hollow construction as above described is shown in cross section in FIG. 2. Accordingly, the same reference numerals previously employed in the FIG. 1 description are used to the extent possible. Said mounting pad 32 is disposed on the rear surface 30 of said sealing rim 26 and projects backwardly to terminate on the rear surface 40 of the parabolic cavity of said reflector member. The hollow region 44 of said mounting pad is defined by the semi-circular wall element 38 which abuts the parabolic cavity wall 48 shown in cross section. A cross sectional portion of the plastic lens member 14 is also shown for better understanding of the overall assembled lamp construction.

Figure 3:
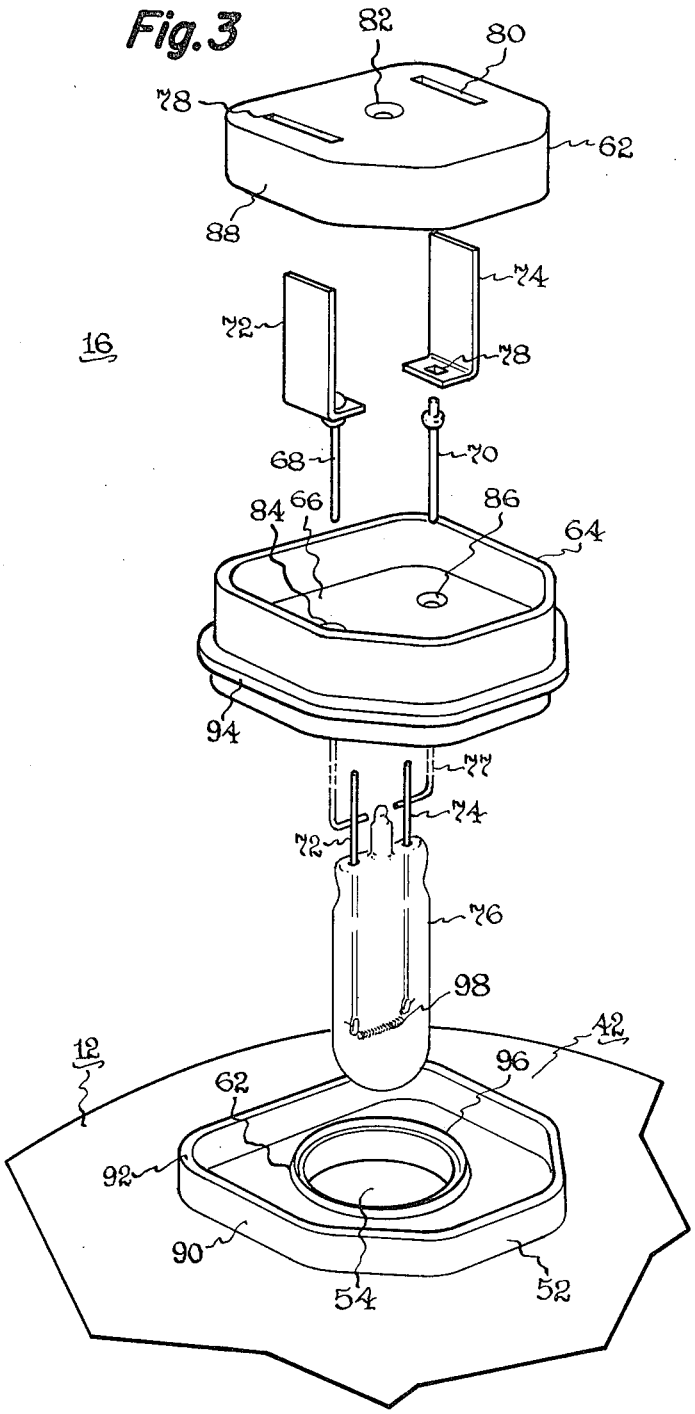
FIG. 3 is a perspective view of an unassembled mount reconstruction according to the present invention which further includes parts of the reflector member to which said mount is assembled and the lamp device also assembled thereto.

Referring to FIG. 3 there is shown the unassembled parts of a prefocused mount and reflector lamp construction of the present invention. Accordingly, said mount construction 16 comprises an assembly of a plastic inner container member 62 which is fitted into an outer plastic housing member 64 to define an enclosed cavity 66 after being sealed together. A pair of lead wires 68 and 70 are joined to metal lug members 72 and 74, respectively, as electrical connecting means extending from opposite ends of the plastic mount construction and which serve to electrically contact the light source 76 to a suitable power supply (not shown). Each of said lead wires is mechanically joined to the L-shaped metal lug member by inserting into a square shape opening 78 and which is followed by mechanical deformation of the circular lead wire to prevent its rotation thereafter. Said lead wires 68 and 70 can also be joined to lamp inleads 72 and 74, respectively, by conventional crimping or welding preferably after bending 77 to impart added mechanical rigidity. The inner plastic block 62 which defines a cavity for receiving the joined lead wires includes a pair of slotted openings 78 and 80 for exit of the metal lug members along with an entrance opening 82 which permits the cavity to be filled with elastomeric polymer after mating with the outer housing member 64. Sealing means provided in this manner not only provides a leak-proof enclosure from the reflector member 12 after assembly thereto but further provides a leak-proof seal around the lead wires upon filling the channel openings 84 and 86 for said lead wires which lead to the interior of the reflector member. The elastomeric polymer can be injected into the cavity opening after the mating plastic parts have been assembled and preferably bonded together by ultrasonic welding at the periphery 88 of the inner member. The elastomer thus encapsulates the lugs and leads and, when cured, provides an adhesive seal between all surfaces to achieve the desired leak-proof enclosure.

The assembled mount construction 16 is suitably joined to reflector member 12 at the raised receptacle means 42 which is disposed on the rear side of said reflector. Accordingly, said receptacle means comprises a box-like member 52 into which the assembled plastic block mount is fitted and which contains a central aperture 54 through which the light source 76 extends after joinder. Wall portions 90 of the receptacle means furnish a support ledge 92 which accomodates the underside surface of a flange 94 extending outwardly from the assembled block mount after joined together as hereinafter described. The circular raised wall 62 which terminates in a peak 96 surrounds the central aperture opening 54 and furnishes the means to ultrasonically bond or otherwise adhesively join the assembled block mount to the receptacle means. The above overall described mount assembly achieves prefocusing of the light source for a reflector lamp in a dual manner for improved alignment of the light source at the focus of said reflector. Specifically, initial prefocusing of said light source is conducted by locating the lamp filament 98 at a predetermined distance from the underside referenced surface or datum plane that is provided by the flange portion 94 of the assembled block mount 16 when said light source is being joined thereto. A final prefocusing of the light source takes place when the assembled block mount and light source is thereafter joined to receptacle means 42 of the reflector member 12.

It will be apparent from the foregoing description to those skilled in the art that various modifications in the present improvement can be made which is still within the spirit and scope of the present invention. For example, it is contemplated that suitable light sources for the present lamp construction include conventional incandescent lamps, tungsten halogen lamps or discharge lamps. It is intended to limit the present invention, therefore, only to the scope of the following claims.

What I claim as new and desire to secure by Letters Patent of the United States is:

1. A reflector lamp which comprises:

(a) a rectangular shaped plastic reflector having a parabolic shaped cavity that includes opposing generally parallel planes which intersect the parabolic contour and terminate in an outer sealing rim, receptacle means disposed on the rear side of said reflector which accommodates a prefocused mount construction to locate a tungsten halogen lamp at the focus of said reflector, and mounting pads on the rear side of rectangular shape in the sealing rim region, said mounting pads having a completely hollow construction to avoid deformation of the parabolic cavity when said reflector member is formed, said mounting pad terminating in an open ended manner on the rear side of said reflector, (b) a rectangular shaped plastic lens sealed to front surface of the sealing rim of said reflector, and (c) a prefocused light source mount sealed to the receptacle means of said reflector, said prefocused tungsten halogen lamp mount comprising at least two lead wires, at least two electrical connecting means joined one each to said lead wires, a hollow plastic block having mating parts defining a cavity for receiving said joined lead wires, an elastomeric polymer in the cavity of said block to provide a leak-proof seal, wherein the mating parts of said block comprise an inner container member defining said cavity and fitted into an outer housing member, said inner and outer members being sealed together after assembly to form a leak-proof enclosure, and said tungsten halogen lamp is externally connected to the end of said lead wires nearest to the focus of the reflector.

2. A reflector lamp as in claim 1 wherein said mounting pads each comprise a semicircular boss element of hollow construction, which is located on the rear surface of the sealing rim and projects backwardly to terminate on the parabolic cavity surface.

* * * * *